United States Patent [19]

Griffiths et al.

[11] 4,339,886

[45] Jul. 20, 1982

[54] LETTERING KIT AND ALIGNMENT GRID THEREFOR

[75] Inventors: Kenneth G. Griffiths, Downers Grove; Stephen C. Woods, Clarendon Hills, both of Ill.

[73] Assignee: Zipatone Inc., Hillside, Ill.

[21] Appl. No.: 172,431

[22] Filed: Jul. 25, 1980

[51] Int. Cl.[3] ..... G09F 7/16

[52] U.S. Cl. ..... 40/595

[58] Field of Search ..... 40/594, 595, 584, 2; 428/40

[56] References Cited

U.S. PATENT DOCUMENTS

| | | | |
|---|---|---|---|
| 1,299,353 | 4/1919 | Kaber | 40/595 |
| 2,262,400 | 11/1941 | Laws | 40/595 |
| 3,315,387 | 4/1967 | Heuser | 40/2 R |

FOREIGN PATENT DOCUMENTS

| | | | |
|---|---|---|---|
| 483436 | 4/1938 | United Kingdom | 40/595 |

*Primary Examiner*—Gene Mancene
*Assistant Examiner*—Wenceslao J. Contreras
*Attorney, Agent, or Firm*—McWilliams, Mann & Zummer

[57] ABSTRACT

A lettering kit and release alignment grid therefor with the lettering kit including pressure sensitive adhesive backed letters and Arabic numerals in a specific font style and supplied in precut form mounted on backing sheet that is release agent coated for readily removal of selected letters and numbers to form desired words and phrases that are to be transfer applied to a desired substrate surface to form signs or the like, in which a special lay out, release agent coated; grid is provided that has guideline indicia keyed to the special shaping of the individual capital letters, lower case letters, and numerals that the font style conventionally has, for layout of the desired word or phrase on the grid to achieve, for transfer to the substrate surface, professional printing appearing letter alignment and spacing in individual word or phrase units, for pickup and transfer as a unit to the substrate surface, using a transfer sheet having a special pressure sensitive coating for this purpose. The pressure sensitive coatings of the letters and numerals, and the transfer sheet have predetermined adhesive differential or release factor relationships for ready pick up of the word units, so formed on the grid, from the grid as a preformed unit, by the transfer sheet, and layout adherence of the letters involved in the unit, to the substrate surface, in the same unit alignment and spacing that was achieved on the grid, with the letter and numeral adherence to the substrate surface being such that the transfer sheet is separated from the letters and numerals involved on a consecutive basis by pulling one end of the transfer sheet toward the other end of same, with the transfer sheet being reusable as needed for similar application of other letter units to the same or other substrates on an as needed basis.

16 Claims, 15 Drawing Figures

HELVETICA 2"

LETTERING KIT AND ALIGNMENT GRID THEREFOR

This invention relates to lettering kits, and more particularly, to kits supplying pressure sensitive adhesive backed letters and numerals of a particular font style, and an alignment grid and transfer sheet for forming, on the grid, from the selection of letters and numerals, a desired word or phrase in unit form, and for providing for manual pick up of the word or phrase unit, from the grid, as formed, and transfer application of same to a desired substrate surface without changing the location of the letters and numerals that are involved in the unit, for forming signs or providing other identification information without having to employ stencilling, painting, or the like.

Heretofore lettering kit arrangements have been proposed involving adhesive backed letters and numerals, alignment grids, and transfer sheets, but where proposed, the individual letters may be supplied in quadrilateral block form to achieve spacing and alignment by juxtaposing adjacent blocks, which requires a separate backing for each letter that has to be separately removed for affixing of the letter or numeral to the desired substrate, or the letters and numerals are arranged for partial adherence temporarily to the front side of a transfer sheet applied between the grid and the letters, with the transfer sheet being adhered to the grid by a separate adhesive coating on the grid, and manually moved therefrom to shift the partially free letters to the substrate surface for adherence thereto of the letter free portions after which the transfer sheet is pulled free of the letters so that the remaining portions may be adhered to the substrate. See, for instance, Richards U.S. Pat. No. 3,440,746 and Mrozek et. al. U.S. Pat. No. 3,761,344.

However, most commercially available lettering kits while providing a full selection of letters and numerals in a particular size for a particular font usually require that the user in making signs and the like, utilizing selected pressure sensitive coated letters and numerals from the kit, to make his own layout guidelines on the substrate, with the individual letters being individually applied to the substrate by the user who tries to achieve consistent alignment and spacing as best he can manually. The result is all too frequently shoddy and unprofessional looking in appearance.

Further, lettering kits that provide the lettering and numerals in conformity to standard font styles present special problems that make professional looking results time consuming and difficult to achieve, especially by those who have little or no experience in working with kits of this type. This is because the letters and numerals that are round in contour, if provided in the same size as the font letters that are at least partially of quadrilateral or rectilinear side or end configuration, tend to look smaller than they really are when employed to form words or phrases; to achieve a more uniform appearance, it has become conventional practice to shape letters and numerals of special font styles for lettering kits, that are of primarily round contour, to be somewhat larger than letters and numerals that have prominent flat or rectilinear marginal contours.

For instance, in Helvetica font style lettering and numerals, for example, where the letters and numerals involved are of a nominal two inch height, the capital letters of primarily straight line marginal contour, such as the letters "T", "A", and "N", have a height of two inches, but the letters of primarily round configuration of the same nominal size will have a height that somewhat exceeds the nominal two inch dimension. This is true with regard to both upper and lower case letters of the standard Helvetica style and Arabic numerals of the same font numerical size, with the result that in addition to the user normally having to construct his own guidelines on the substrate surface, he will find that the letters and numerals of the same font nominal size are of varient heights in addition to varient shaping, thus further complicating efforts to provide something reasonably approaching a perfectly shaped word or words on the substrate.

A principal object of the present invention is to provide, in a lettering kit arrangement of the type indicated, an alignment grid that permits the user to readily put together manually a perfectly shaped and balanced word or phrase and apply same to the substrate without having to manually form guidelines on the substrate surface involved.

Another principal object of the invention is to provide a lettering kit of the type indicated in which the letters and numerals forming a word or phrase as laid out on the alignment grid may be readily picked up and transferred as a unit from the grid to the substrate surface for permanent adherence thereto without disturbing the relative position of the letters and numbers that has been achieved by manual positioning of same on the grid.

Another principal object of the invention is to provide for lettering kits of the type indicated a release agent coated grid sheet that serves as the word layout sheet for forming words and phrases from Helvetica font lettering of a selected nominal size, which has delineated on the grid sheet an alignment grid for the nominal size of Helvetica font lettering forming the kit, which grid has guiding base lines located with reference to four basic categories of letter and number shaping of the Helvetica style font of the nominal height size involved.

Other objects of the invention are to provide a lettering kit that permits anyone to manually lay out and apply to any substrate surface a perfectly shaped word or phrase, using preformed pressure sensitive adhesive backed lettering, without applying guidelines to the substrate, and without having to require professional training for this purpose.

In accordance with the invention, a lettering kit and alignment grid therefor are provided in which the letters and numerals for the kit are English alphabet letters and Arabic numerals of the Helvetica font style in a selected nominal height, such as, for instance, two inches. The letters and numerals are preformed on vinyl sheeting having a pressure sensitive adhesive coating of special characteristics applied to the back side of same to which is applied a conventional release agent coated backing or carrier sheet; the letters and/or numerals desired to form a word, words, or phrase for a sign or the like may thus be individually removed from the sheets of lettering and numerals provided which supply the lettering in both capital or upper case and lower case form having the specific contouring that is of the Helvetica style. Associated therewith is a release agent coated alignment grid sheet having delineated on the release agent coated side of same a special grid for laying out in uniform spacing and arrangement as desired the letters and/or numerals selected to form the sign indicia or the like to form a word or phrase unit to be transferred, as such, to the substrate surface by a special pressure sensitive adhesive coated transfer sheet for that purpose that is normally adhered to a release coated backing that is manually removed for word unit transfer purposes.

The grid sheet supplied with the kit may have a number of grids delineated on same, each proportioned to be applicable to different nominal height dimension of Helvetica font lettering. The grid for each Helvetica font lettering nominal height involved includes across the grid working face a head or upper horizontal base line indicia, and a foot or lower horizontal base line indicia, both being of special significance. The foot base line indicia for a specific Helvetica font nominal height size comprises a top base guideline, a middle base guideline, and a bottom or lower base guideline, all three extending in parallelism across the working face of the grid sheet, with the middle base guideline centered between the indicated top and bottom base guidelines.

The head base line indicia for the grid for a particular Helvetica lettering nominal height lettering and numeral selection comprises a base line provided above the foot base line indicia middle base guide line a dimension that is three-fourths of the nominal lettering height involved.

The foot base line indicia top and bottom base guidelines for the nominal lettering height selection to be used with the grid, are spaced for the middle base guideline thereof a distance approximating one-half the difference between the height of the font capital letters of the nominal height dimension involved that have horizontally rectilinear upper and lower ends, and the height of the font capital letters of the same nominal height that have rounded upper and lower ends.

In accordance with the invention, the pressure sensitive adhesive forming the coatings of the letters and numerals and the transfer sheet have a special relationship providing an adhesion or tack differential. The lettering and numeral adhesive is to have a low or nominal tack relationship with the grid release agent coated surface for ready application to and adjustment on the grid sheet with respect to the grid; however, the adhesive coating for the lettering and numerals is to have a high tack relationship with respect to the substrate surface, but includes suitable setup retardants in the adhesive to delay the permanent setup of the adhesive that will give permanent adhesion to the substrate.

As indicated, the letters and/or numerals selected to form a particular word to be applied to the substrate surface are properly oriented and aligned on the grid appropriate for the nominal height size of the lettering involved, with the lettering and/or numerals selected resting on the grid release agent coated surface with low tack with respect thereto. The transfer sheet has its pressure sensitive adhesive coated side exposed for transfer purposes, by manually moving the release agent coated backing sheet thereof, with the transfer sheet then being laid with its pressure sensitive adhesive coated side on top of the letters and/or numerals making up the word or phrase unit to be transferred. The user by employing a finger pressing burnishing action presses the transfer sheet adhesive coating into firm adherence with all areas of the letters and/or numerals involved in the word unit to be transferred, after which the work unit is pulled free of the grid sheet by pulling one end of the transfer sheet away from the grid sheet, and generally in the direction of the other end of the transfer sheet.

With the transfer sheet free of the grid sheet, the transfer sheet is then disposed adjacent the sustrate surface to which the word unit in question is to be applied, with finger burnishing action again being employed to press the letters and/or numerals involved in firm adherent relation to the substrate surface. When this is done, the transfer sheet is separated from the letters and/or numerals adhered to same by grasping one end of the transfer sheet and pulling it toward its other end in an approximate 180 degree angulation movement actuation, to consecutively separate the transfer sheet from the letters and/or numerals making up the word unit that is now affixed to the substrate surface.

In accordance with the invention, the transfer sheet involved, which may be a sheet of polyethylene film, has its pressure sensitive adhesive coating in the special adhesive or tack differential relative to the adhesion or tack of the lettering and numeral pressure sensitive adhesive. The adhesion or tack of the transfer sheet adhesive to the front surfacing of the letters and numerals is substantially greater than the adhesion or tack of the adhesive of the letters and numerals to the grid release coating, but the adhesion or tack of the transfer sheet to the front side of the letters or numerals must be substantially less than the adhesion or tack of the lettering and numeral adhesive with respect to the substrate surface. Further, as the transfer sheet is provided with the kit to be reused as needed, the transfer sheet adhesive includes setup retardants or preventives so that on a long term basis the transfer sheet adhesive coating will serve its function of permitting the transfer sheet to pick up assembled word units on the grid and transfer the letters and/or numerals involved to a desired substrate surface and then provide for the indicated release of same, to effect application of the resulting word unit to such substrate surface in the same letter and/or numeral orientation that has been provided in making the unit up on the grid sheet.

The invention contemplates that in practice it will be routinely possible, by the practice of the invention, to achieve perfect spacing and orientation of the letters and/or numbers required to make up a word unit to be applied to a particular substrate surface, and the application of same to the desired substrate surface, with resulting professional compentency of appearance that has not been heretofore possible in connection with prior art kit arrangements.

Other objects, uses, and advantages will be obvious or become apparent from a consideration of the following detailed description and the application drawings in which like reference numerals indicate like parts throughout the several views.

In the drawings:

FIG. 1 is a diagrammatic plan view of a grid sheet arranged in accordance with the present invention for use with lettering and numerals of the Helvetica font style having a two inch nominal height, with parts being broken away to expose other parts, and showing applied thereto the letters, from a selection of letters and numerals of the Helvetica font nominal height size in question, that is provided by the kit of this invention, a word unit, for the purpose of forming or providing same on a substrate surface, such as on a mailbox or business sign, or the like;

FIG. 2 is a diagrammatic fragmental sectional view substantially along line 2—2 of FIG. 1, showing on an enlarged scale the grid sheet in transverse section, with the letters shown applied to same in FIG. 1 illustrated in diagrammatic elevation;

FIG. 3 is a fragmental perspective view of the kit transfer sheet and the backing sheet with which it is associated, and which is removed for pickup and transfer of the words or phrases, formed by the practice of the invention (on the grid of FIG. 1), to the substrate surface that the word or phrase is to be permanently adhered to, with the transfer sheet shown partially separated from its backing;

Figures 1, 2, 3, 4, 5, 6, 7:
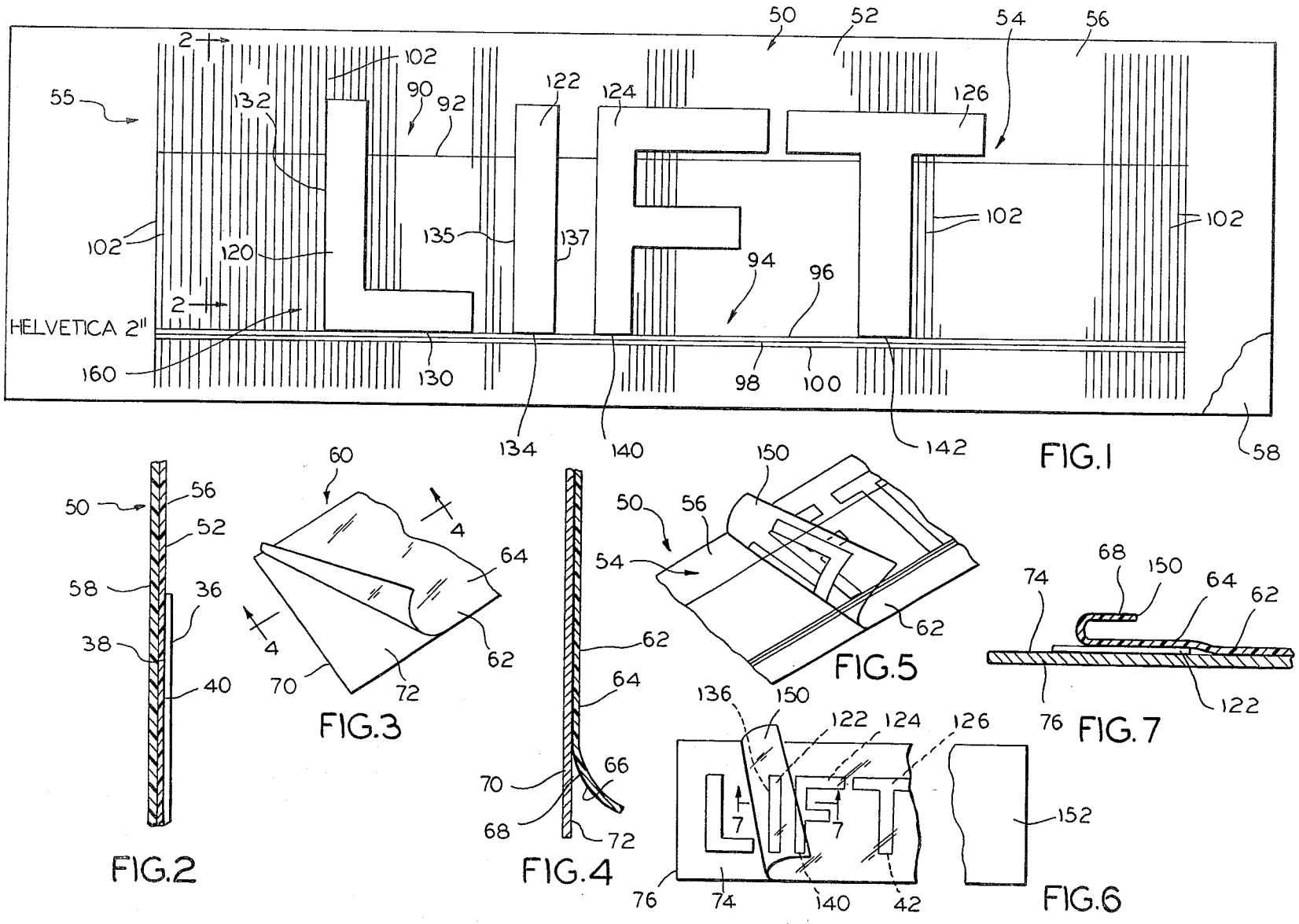
FIG. 4 is a fragmental sectional view of the transfer sheet shown in the process of being separated from its backing and taken substantially along line 4—4 of FIG. 3.
FIG. 5 shows the transfer sheet after it has been applied to the letters and/or numerals forming the word or phrase unit that has been laid out on the grid of FIG. 1, in the course of being separated from the grid to also separate from the grid sheet the word unit in question.
FIG. 6 illustrates the transfer sheet in association with the substrate surface after the letters making up the word unit have been finger burnished against the substrate surface to affix them thereto, with the transfer sheet shown in the process of being removed from the substrate and the letters now adhered to the substrate.
FIG. 7 is a fragmental sectional view taken substantially along line 7—7 of FIG. 6, illustrating the manner in which the transfer sheet is removed from the substrate and specifically from the letters that have now been adhered to the substrate.
Figure 12:
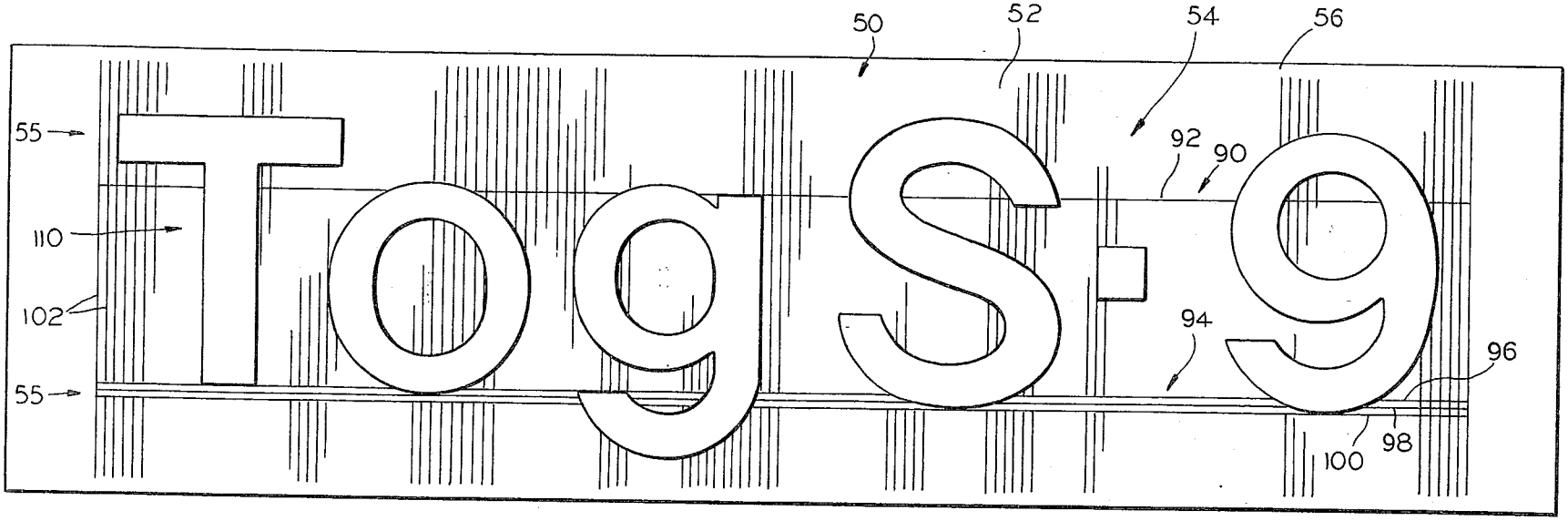
Figure 14:
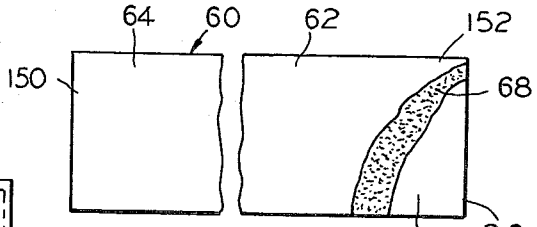
Figure 15:
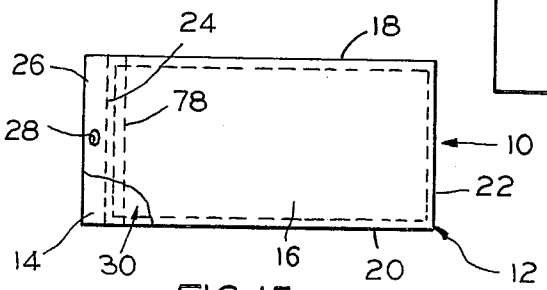
Figure 13:
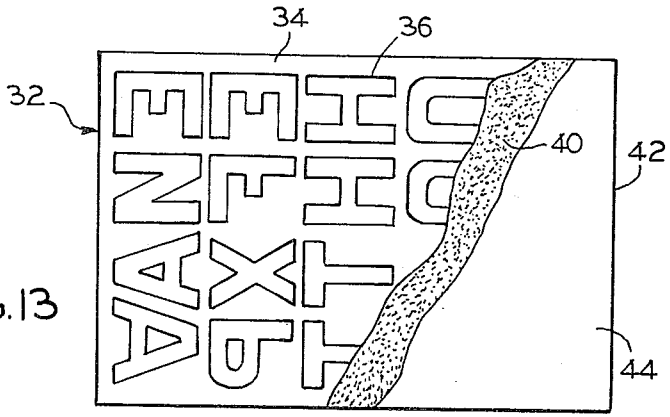

FIG. 12 is a view similar to that of FIG. 1, but showing a word unit made up of Helvetica lettering and numerals from the varient groups or classes of Helvetica upper and lower case letters and numerals indicated applied to the grid using the respective base guidelines with which the respective letters and numerals are to be associated in laying out the word unit to be constructed, in accordance with the invention;

FIG. 13 is a plan view of a sheet of Helvetica letters and numerals of the type that is supplied with the kit in question from which individual pressure sensitive adhesive backed Helvetica letters and numerals may be removed for forming word units such as those illustrated in the drawing FIGS. 8–12, with parts broken away to expose other parts;

FIG. 14 is a plan view of the transfer sheet illustrated in FIGS. 3 and 4, with parts broken away to illustrate other parts; and, FIG. 15 is a small scale plan view of the kit itself, with the components illustrated in FIGS. 1–14 being contained within a transparent container of the plastic film type arranged for hanging support at, for instance, the retail establishment where the kit is to be sold.

However, it is to be distinctly understood that the specific drawing illustrations supplied are provided primarily to comply with the requirements of the Patent Laws, and that the invention is susceptible of variations and modifications that will be obvious to those skilled in the art, and which are intended to be covered by the appended claims.

GENERAL DESCRIPTION

Reference numeral 10 of FIG. 15 illustrates diagrammatically a lettering kit in accordance with the present invention that contains in a flat container type carrier 12 of quadrilateral configuration formed from polyethylene film or the like the various components of the kit illustrated and described in detail in this application. The carrier 12 in practice may be of any suitable type and for purposes of illustration is shown to comprise two sheets 14 and 16 of polyethylene film sheeting of a suitable gauge joined together at the sides 18 and 20 and at the end 22 of same by suitable heat bonding techniques, with the carrier being heat bonded closed along seal line 24 at the carrier upper end 26 which may be suitably apertured as at 28 to hang from a hook or the type support at the point of sale of the kit. The contents of the kit are generally indicated by reference numeral 30 and comprises several composite sheets 32 (see FIG. 13) each comprising in the illustrated embodiment a vinyl sheet 34 having an uncoated front side or facing 36 and a back or underside 38 (see FIG. 2) that bears a coating 40 of pressure sensitive adhesive to which is removably adhered a backing sheet 42 having a release agent coated surfacing 44 that is applied in low tack relationship to the adhesive coating 40. As is conventional for composite sheets of the type represented by sheet 32, the vinyl sheeting is precut or scored through the vinyl sheet, in any suitable manner, to define letters and numerals in the Helvetica font style, and in the case of the illustrated embodiment, the letters and numerals are proportioned in accordance with the nominal two inch size Helvetica lettering. The sheets 32 supplied with kit 10 are sufficient in number to provide the user of the kit with two to three duplicates of the capital letters, lower case letters, arabic numerals, commas, dollar and cents signs, and other indicia normally a part of the Helvetica font press in place lettering style.

The kit 10 also includes, in accordance with the invention, release agent coated grid sheet 50 defining a working surface or face 52 on which is delineated the nominal layout grid 54 of this invention over which is applied release agent coating 56.

Kit 10 further includes transfer sheet assembly 60 which is supplied with the kit and comprises transfer sheet 62 that is in the form of a polyethylene film of a suitable thickness and transparancy in defining uncoated side 64 and an underside 66 (see FIG. 3) which has applied to same pressure sensitive adhesive coating 68 to which is adhered, when the transfer sheet 62 is not being used, a backing sheet 70 of the same size and shape as the transfer sheet 62 that has a release agent coating 72.

In accordance with the invention, the user of the kit is enabled to select lettering and/or numerals from the sheets 32 to form words or phrases or the like to be applied to any substrate surface, such as a mailbox, sign, wall surface, or the like, to provide wording or phraseology, the letters and/or numerals of which are uniformly spaced and oriented within the word group in the perfect spacing and orientation characteristic of a professional printing job. This is done by the user, in laying out on the grid 54 the Helvetica lettering and/or numerals that are involved to form a word or phrase unit, so that by using the guidance provided by the grid the user is permitted to automatically achieve the desired perfect spacing and orientation that is the objective of the invention, and then by using the transfer sheet 62 the word or phrase unit so formed is transferred as a unit to, and affixed to, the substrate surface, such as the surface 74 of the sign 76 shown in FIG. 6, without disturbing the orientation of the letters and/or numerals involved, and without having to apply to the substrate surface 74 manually drawn guidelines.

The kit carrier 22 may be formed with serration line 78 for conveniently opening the carrier 22 by severing the carrier sheet 16 along the line 78, for access to and removal of its contents.

SPECIFIC DESCRIPTION

The composite letter and numeral sheeting 32 structurally is conventional in nature, with the letters and numerals and other indicia provided being shaped in accordance with the usual Helvetica capital and lower case lettering and numeral configurations. The preforming or delineation of the letters and numerals and other indicia involved may be effected in any convenient and conventional manner for severing the vinyl sheeting 34 so that the user may manually separate from the composite sheet 32 the selected letters and numerals that are desired to form a particular word or phrase unit to be applied to a substrate surface 74.

The backing sheet 44 of the composite sheets 32 may take the form of a suitable paper based or polymeric film having the release agent coating 40 applied thereto that may be in the form of a suitable silicone or silicone rubber coating of one of the types commonly known to this art whereby the vinyl sheet 34 and the letter and numeral components defined by same are releasably adhered to the coating 44.

The pressure sensitive adhesive coating 40 may be one of a number of types known to this art, such as a suitable rubbery polymeric material compound with suitable compatible resinous tackifiers and dispersed in appropriate solvent with the compound containing other ingredients as needed, such as anti-oxidants, light stabilizers, color pigments, softening agents, curing agents, stiffening agents, fillers, etc. to impart or modify particular properties; typically useful rubbery polymeric materials include natural rubber, synthetic rubber, latex, crepe rubber, rubbery synthetic polymers and copolymers, acrylics, and the like. Commonly used tackifiers include rosin esters such as ester gum, wood rosin and various types of resins. The adhesive coating 40 is to be firmly bonded to the vinyl sheeting 34 so as to not separate from it during normal use of the lettering and numerals.

In addition, the adhesive coating 40 is provided with setup retardants so as to have low tack with regard to the grid sheet release agent coating 56, but so as to provide for permanent adherence to the substrate surface 74 with applied thereto and the adhesive fully sets up.

The grid sheet 50 comprises a sheet of polyester film laminate 58 having its working face 52 provided with release agent coating 56 that may be formed by one of the silicone or silicone rubber coatings commonly known to this art, which is baked as part of the processing procedure. The grid 54 is of special significance in use relative to the Helvetica capital and lower case letters and numerals involved and its details will be described hereinafter.

The transfer sheet assembly 60 supplies the transfer sheet 62 itself, which in a preferred form is formed from polyethylene film of good transparancy characteristics and is proportioned in length and width to be at least coextensive with the grid 54 so that it may be placed in overlying relation with the word or phrase unit formed on the grid 54 in practicing this invention for transferring the Helvetica letters and/or numerals involved from the grid sheet 50 to the substrate surface 74. Transfer sheet 62 has its pressure sensitive adhesive coating 68 applied thereto on its underside 66 in any suitable manner with the adhesive 68 being of one of the types indicated above including setup retardants or negatants to insure that the letters and numerals will have ready release from the transfer sheet in use and reuse of same as needed for a useful life of resonable duration.

A feature of the invention is that the adhesive coatings 40 and 68 have a release or adhesive differential of special characteristics. As a general guide, the adhesive forming the coating 40 of the sheets 32 should have a release relation relative to the grid sheet coating 56 on the order of 20 grams while the adhesive coating 40 as employed to a substrate surface 72 is to have a release relation well in excess of 200 to 300 grams or more and provide for such controlled setup of the adhesive so as to be permanently adhered to the substrate surface within a reasonable amount of time.

The adhesive coating 68 of the transfer sheet 62, on the other hand, should have a release relation with respect to the facing side 36 of the vinyl sheet 34 in the range of from about 70 to about 90 grams, but as to substrate surfaces represented by substrate surface 74, the adhesive 68 should have a release relation in the range of from about 100 to about 120 grams. Coating 68 should have a release factor relative to grid sheet coating 56 approximating that of coating 40.

The backing sheet 70 may be formed from styrene or the like and has a shape the same as that of transfer sheet 62. The release agent coating 72 of the backing sheet 70 may be one of the silicone or silicone rubber compositions referred to above. While the transfer sheet 62 is preferably transparent, the backing sheet 70 may be translucent or colored to distinguish it from the transfer sheet 62.

Referring now more specifically to the grid 54 of grid sheet 50, the grid 54 comprises head base line guide indicia 90 that takes the form of rectilinear guideline 92 that extends longitudinally of the grid 54 and across its working face 52. Grid 54 also comprises foot base line guide indicia 94 comprising upper base guideline 96, middle base guideline 98 and lower base guideline 100, with the guideline 98 being centered between the guidelines 96 and 100.

Guidelines 96, 98 and 100 parallel guideline 92 and extend across working face 52 of the grid sheet 50 and thus may be considered horizontal guidelines that make up the grid 54.

Grid 54 also includes spaced guidelines 102 that are perpendicular to guidelines 92, 94 and 98 and thus are in the nature of vertical guidelines, which are spaced apart across the working face 52 of the grid sheet working surface 52. The vertical guidelines 102 are employed to aid the kit user in appropriately spacing apart and disposing in correct upright position the letters and numerals that are assembled on the grid 54 in accordance with the practice of the invention.

The horizontal guidelines 92, 96, 98 and 100 are spaced and utilized in relation to the conventional shaping and proportioning of the Helvetica font letters and numerals for the nominal letter size that is to be used with the grid 54. In the illustrated embodiment, a Helvetica nominal letter size two inches in height is employed, but the spacing proportioning involved is applicable to all Helvetica lettering nominal height sizes.

In accordance with the invention, the head base guideline 92 is located above the foot middle base guideline 98 a distance equivalent to three-fourths of the nominal height of the Helvetica lettering to be used with the grid 54. As the illustrated Helvetica letter nominal size is two inches, the spacing between guidelines 90 and 98 should be one and three-quarter inches.

Further, the invention contemplates that the foot upper and lower guidelines 96 and 100 are to be spaced apart one-half the difference between the height of the Helvetica capital letters for the nominal two inch height size that have upper and lower end configurations that are predominantly horizontal rectilinear, and the height of the Helvetica font capital letters of the same nominal size that have upper and lower end portions that are predominantly if not entirely rounded. For example, the Helvetica capital letters "L", "T", "A", and "N" have the two inch nominal height, which is 5.08 centimeters on the metric scale; the fully or largely rounded Helvetical capital letters such as the letters "S", "O", and "Q" have a height of 5.48 centimeters, and thus the foot base guidelines 96 and 100 for the two inch Helvetica lettering nominal height are spaced apart one-half of four millimeters or two millimeters with foot guideline 98 centered therebetween.

As indicated, the indicated relative spacing of guidelines 92, 96, 98 and 100 holds proportionately for the various nominal height sizes of Helvetica letters. It follows that grid sheets 50 may be modified to combine separate grids 54 for the various Helvetica nominal height sizes to be made available, with the separate grids 54 being in superposed parallel rows or grid ways 55 across the face of the suggested grid sheet in order of the nominal letter height sizes to be handled by the grid sheet as, for instance, ranging from the smallest size at the top of the grid sheet to the largest size at the bottom of the grid sheet, and appropriately identified, as indicated in FIG. 1 for the two inch nominal Helvetica size.

Figure 8:
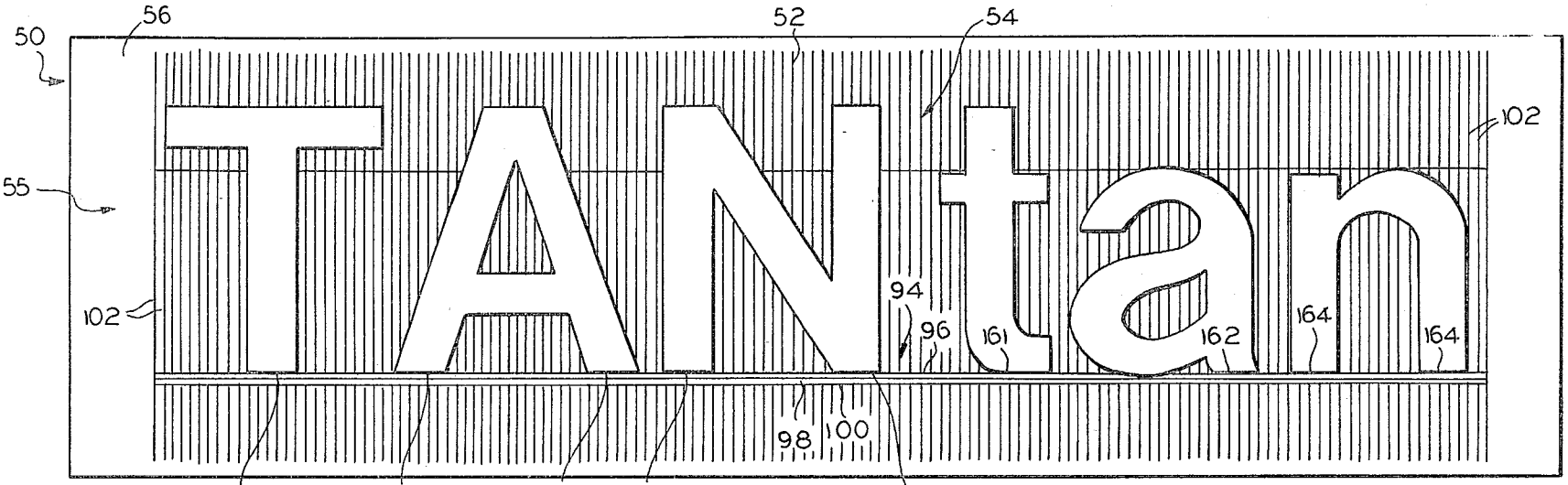
FIG. 8 is a view similar to that of FIG. 1, showing applied to the grid of this invention typical Helvetica capital and lower case letters that in accordance with the system of this invention are to be laid out on the grid in association with the top guideline of the grid foot base line indicia.

In any event, for any specific Helvetica letter nominal height size kit to be utilized to apply desired wording or phraseology to a substrate surface 74, the following guidance principles are to be observed in using the various Helvetica letters and numerals in association with grid 54 that is to be used for that particular letter nominal height size:

The Helvetica capital letters having predominating horizontal rectilinear lower ends, and the Helvetica lower case letters having lower ends that are significantly or predominating horizontally rectilinear, are to be applied to the grid 54 with such lower ends aligned with the foot upper base guideline 96, as illustrated in FIGS. 1 and 8. This applies to capital letters "A", "B", "D", "E", "F", "G", "H", "I", "K", "L", "M", "N", "P", "R", "T", "V", "W", "X", "Y", "Z", and lower case Helvetica letters "a", "b", "d", "f", "h", "i", "k", "l", "m", "n", "r", "t", "u", "v", "w", "x", "z"; the Helvetica numerals "1", "2", "4", and "7" also fall into this category.

The Helvetica lower case letters are essentially rounded in outline or configuration, namely the letters "e", "c", "o" and "s" are applied to the grid 54 with their lower ends tangent with the foot middle base guideline 98.

Figure 9:
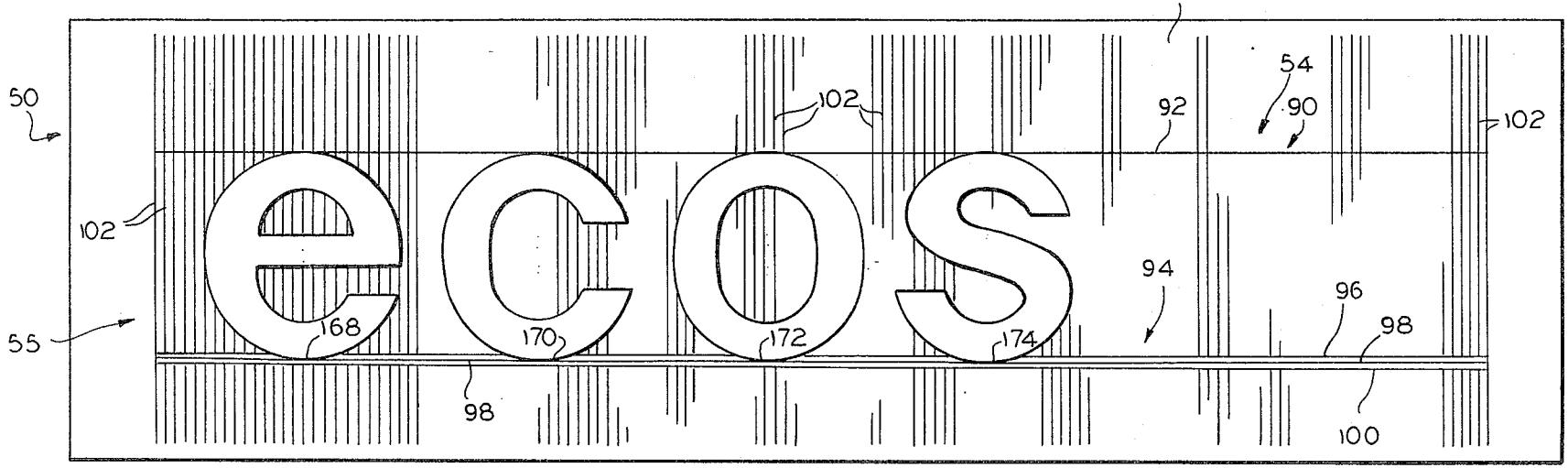
FIG. 9 is a view similar to that of FIG. 1, but illustrating the Helvetica font lower case letters that in accordance with the system of this invention are to be laid out on the grid in association with the grid foot guide indicia middle base guide line.

This is illustrated in FIG. 9.

Figure 10:
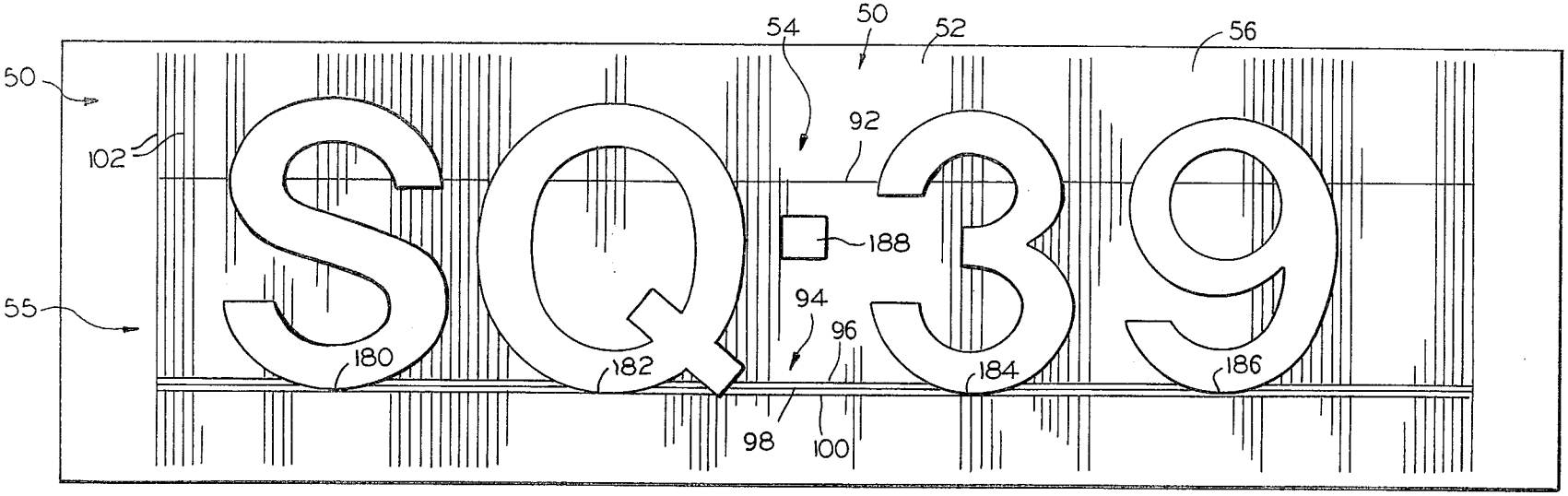
FIG. 10 is a view similar to that of FIG. 1, but illustrating the application to the grid of selected letter items of the group of Helvetica font lettering and numerals that are to be laid out in association with the foot base line indicia lower base guide line.

The Helvetica capital letters and numbers that have essentially rounded lower ends are applied to the grid 54 with their lower ends tangent with the foot lower base guideline 100, as illustrated in FIG. 10. The letters and numerals involved are the letters "C", "J", "O", "Q", "S", and "U", and the numerals "3", "5", "6", "8", "9" and "0".

Figure 11:
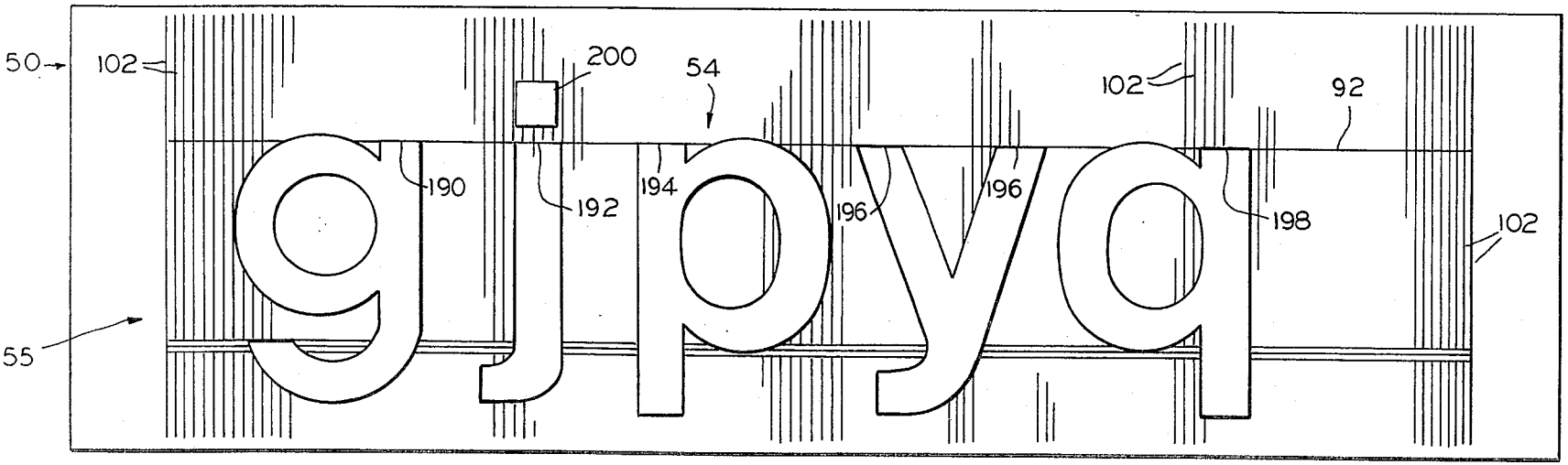
FIG. 11 is a view similar to that of FIG. 1, but illustrating applied to the grid the Helvetica lower case lettering for the nominal Helvetica letter size indicated that are to be applied to the grid in association with the head or top base guide indicia guide line.

The Helvetica font lower case letters that are elongated in the sense that their height is greater than their width, and that have upper end portions that are predominently or significantly horizontally rectilinear are applied to the grid 54 with their rectiliner upper portions aligned with the head base guideline 92, as indicated in FIG. 11, so as to extend downwardly of the grid and across the foot base guideline indicia 94. This applies to the remaining Helvetica lower case letters "g", "j", "p", "y", and "q".

In following these principles, the individual Helvetica letters and numerals are applied to the grid utilizing the vertical guidelines 102 as a spacing guide between letters and/or numerals. In a preferred embodiment of the invention, the vertical guidelines 102 have a spacing equivalent to sixty-nine subdivisions in five inches of length horizontally of the grid 54. Guidelines 102 also aid in insuring that the letters and numerals are properly upright, by establishing parallelism with lines 102.

FIG. 12 illustrates a word unit 110 made up of Helvetica font letters and numerals selected from the four guide categories enumerated above, from which it can be seen that by observing the principles disclosed herein in laying out the word unit 110 on grid 54, the letters of the word unit will be perfectly spaced and aligned horizontally and vertically of the grid, and this is obtained automatically by the kit user following the guiding principles disclosed herein.

METHOD OF PRACTICING THE INVENTION

Assuming that one has a kit 10 in hand supplying in the form of composite sheets 32 all of the capital and lower case letters and numerals of the Helvetica font style in its nominal two inch size, and the user has need of applying, for instance, the word "LIFT" to the substrate surface 74, bearing in mind the guidance principles for using grid 54, it is first noted that the four letters involved in this word are all capital letters which have horizontally rectilinear lower end portions or bottoms. This means that all four letters may be laid out on the grid working surface 52 using the grid foot upper base guideline 96. Accordingly, the individual letters making up the word "LIFT" are consecutively separated from the appropriate composite sheet 32 bearing such letters, which are indicated by reference numerals 120, 122, 124, and 126 in FIGS. 1 and 6. In doing this, the user may first separate, for instance, a letter 120, for its carrying composite sheet 32, and drop it adhesive side down on the grid working surface 52 of a grid sheet 50 supported horizontally. The low tack relationship of the adhesive 40 without the letter 120 being pressed against the release coating 56, permits the letter 120 to be slid or skidded as necessary across the grid sheet working surface 52, using one's fingers as needed for this purpose, to align its rectilinear lower end portion 130 with the foot base guideline 96, adjacent the left hand end of the grid 54, as shown in FIG. 1. For horizontal spacing purposes, the vertical side edge 132 of the letter is aligned with a conveniently available vertical guideline 102, which also insures true upright positioning of letter 120 on grid 54.

The letter 122 is then handled in a similar manner with its rectilinear lower end 134 being placed in alignment with the foot base guideline 96, and the vertical side edge 135 of same that opposes the letter 120 being spaced from the letter 120 by an appropriate number of vertical guidelines 102, as is desired by the user to achieve uniform spacing between the letters of this word. By taking care to insure that sides 135 and 137 parallel guidelines 102, proper upright positioning of letter 122 is assured.

Similarly, the letters 124 and 126 are handled in a similar manner to align their rectilinear lower ends 140 and 142 with the foot base guideline 96, with appropriate horizontal spacing between these adjacent letters being suggested by the intervening guidelines 102 and the user's sense of order and balance. As indicated, the guidelines 102 insure that for four letters such as letters 120, 122, 124 and 126, which have rectilinear lower portions of relatively short lengths, these letters will be applied in true upright relation by maintaining parallelism between the vertical guidelines 102 and the corresponding upright rectilinear sides of the letters.

As each letter is put into its desired final position on the grid 54, the user applies a light burnishing action on top of the letters and against the grid sheet 50 to obtain sufficient adherence of the letters to the grid sheet to hold them in their desired positions of location on the grid.

The user now takes the transfer sheet assembly 60 and separates from same its backing sheet 70, as suggested by FIGS. 3 and 4, which is done by separating the two sheets at one edge or corner of the assembly and then pulling the transfer sheet 62 away from its backing 70, as is also suggested by FIGS. 3 and 4.

The transfer sheet 62, which preferably has a size that at least roughly proportion the grid way 55 being used, is then laid in coextensive relation with such grid way 55, with the transfer sheet adhesive coating 68 facing the letters 120, 122, 124 and 126 and grid sheet release coating 56. The user then burnishes or rubs the transfer sheet 62, on its side 64, against all portions of the underlying letters using finger or thumb action, to effect adherence of the letter forward facing 36 to the transfer sheet 62.

When this has been done for all letters, one end of the transfer sheet, such as its left hand end 150 of FIGS. 5 and 6, is pulled away from the grip sheet 50, moving in this instance the end 150 longitudinally of the grid 54 towards its right hand end 152. This movement is done carefully and deliberately and as it occurs the letters 120, 122, 124 and 126 are consecutively rolled away and separated from the grid sheet 50, and in particular its release agent coating 56. After the last letter 126 is separated from the grid sheet 50, the transfer sheet will rapidly separate from the grid sheet since ordinarily no finger pressure is applied to the transfer sheet outside of the underlying areas of the letters being transferred when the user is going through the procedure of adhering the letters to the transfer sheet coating 68.

With the transfer sheet 62 free from the grid sheet 50, the transfer sheet 62 may then be moved to the substrate surface 74 and placed thereagainst, with care being taken to properly align and position the transfer sheet 62 with respect to the surface 74 as may be desired to achieve horizontal disposition of the word unit involved, where that is desired. The transfer sheet then may be lightly pressed against the substrate surface 74 to lightly hold it in the desired position, after which the user, again using his fingers and/or thumb, burnishes the individual letters against the surface 74, by running one's fingers or thumb across the portions of the transfer sheet side 64 overlying the letters underlining the transfer sheet 62, which will be fully visible through the transfer sheet 62 because of its transparent nature. After all portions of the letters of the word unit involved have been so worked on to obtain adherence of their coatings 40 with the substrate surface 74, one end of the transfer sheet, such as its end 150, is grasped and separated from the substrate surface, and also moved toward its other end, in this instance end 152, at a substantial 180 degree angulation, as indicated in FIG. 7. The end 150 of the transfer sheet is moved slowly towards its other end 152, and as it is so moved the transfer sheet consecutively rolls away and separates from the individual letters 120, 122, 124, 126, and is then pulled free from the substrate, to leave the letters in question transferred and permanently applied to the substrate surface 74.

The backing sheet 70 is then reapplied to the transfer sheet 62 to preserve its adhesive coating for future use in a similar manner, assuming the user has completed current work with kit 10.

It will thus be seen that the invention contemplates that the letters of an individual word or phrase laid out on the grid sheet in association with the grid 54 are to be applied thereto in a unit 160 of perfect alignment and spacing, with the resulting word unit being picked up by transfer sheet 52, as such unit, and applied to the substrate 74, as such unit, all without changing the orientation or positioning of the letters of the word that is achieved in final form by employing the grid 54.

FIGS. 9–11 illustrate the use of the grid sheet 50 and its grid 54 for similar and other shapes of the various letter and numeral configurations that are a part of the conventional Helvetica font style.

In the showing of FIG. 8, the capital letters "T", "A", and "N" have the indicated horizontally rectilinear lower end portions 154, 156 and 158 that key their placement on the grid 54 in alignment with the lower foot upper base guideline 96. As indicated above, the Helvetica lower case forms of these letters also fall in the same class, and accordingly the horizontally rectilinear lower end portions of same, indicated at 161, 162, 164 are aligned with the lower foot upper guideline 96. Vertical guidelines 102, as indicated, are relied on to effect the desired spacing between letters and insure their upright positioning by the user taking care to position the rectilinear upright portions of the letters involved in parallelism with the vertical guidelines 102.

In the showing of FIG. 9, the grid sheet, and specifically its working surface 50, has applied thereto the four Helvetica lower case letters that are essentially round in configuration. As indicated by the guidelines described above, these letters are applied to the grid 54 with their convexly curved undersides tangent with the foot middle base guideline 98, as indicated at 168, 170, 172 and 174.

In the showing of FIG. 10, the grid sheet 50 has applied to its grid 54 the Helvetica capital letters "S" and "Q" as well as the numerals "3" and "9". These letters and numerals fall in the category of letters and numerals that are applied to the grid 54 using the foot lower base guideline 100, by way of their convexly curved lower portions being placed in tangency thereto, as indicated at 180, 182, 184 and 196. Here again, the vertical guidelines are relied upon to effect desired spacing of the letters and numerals and proper upright orientation of same in spite of the rounded and acruate nature of these letters and numerals.

FIG. 10 also illustrates the use of a Helvetica font "dash" configuration, which is illustrated at 188, and as is conventional, the composite sheets 32 have their sheets 34 subdivided to also define dashes, commas and the like. The "dash" 188 is applied between the letter "Q" and the numeral "3" in the showing of FIG. 10 to give the designation "SK39"; the vertical guidelines 102 are employed to properly space the dash 188 between the letter "Q" and the numeral "3" and properly orient the same for correct upright position. The user is guided by the heights of the letters and numbers in question that have been applied to the grid 54 in placing the dash 188 at approximately the mid-height of same.

In the showing of FIG. 11, the category of the Helvetica lower case letters is illustrated that are applied to the grid 54 using its head base guideline 92 as the guide. Thus, for this category of letters, which are relatively elongated in terms of their height relative to their width, the letters also have prominent upper end portions that are horizontally rectilinear, and it is these end portions that are placed in alignment with the guideline 92, as indicated at 190, 192, 194, 196 and 198. Here again, the vertical guidelines 102 are relied upon to properly space the letters in accordance with the sense of proportionate and balance the user desires to employ in connection with the lettering involved, and also, the rectilinear upright portions of these letters by being placed in parallelism with the vertical guidelines 102 insure their upright positioning on the grid.

FIG. 11 also illustrates the use of a conventional "dot" for the lower case letter "j", which is indicated at 200, and is one of the conventional letter configurations normally supplied by a composite sheet 32. The "dot" 200 is readily applied to the grid 54 by the user, with appropriate spacing between the dot 32 and the upper end of the underlying major portion of the letter "j" being observed as well as appropriate positioning of the sides of the dot with respect to the guidelines 102.

In the showing of FIG. 12, the grid 54 bears the word unit 110 that is made up by letters and numerals from all four special categories of Helvetica letters and numerals that have been set forth hereinbefore. It will be noted that by following the guiding rules with regard to the grid 54 and the application of the individual letters and numerals thereto, the letters that are indexed with respect to the grid 54 employing the foot base guidelines 96, 98 and 100 will extend vertically above the foot for appropriate association with the Hevetica lower case letters that are applied to the grid using the head base guideline 92. Similarly, those Helvetica lower case letters that are to be applied or indexed to or with respect to the grid 54 utilizing the head base guideline 92 (which are the letters shown in FIG. 11) will project across the height of the grid appropriately for balanced association with the other letters and numerals to be applied to the grid 54, as indicated in FIG. 12.

It follows, of course, that the letter arrangements that have been illustrated in FIGS. 8–12 may be transferred to a desired substrate surface 74 in the same manner as described in connection with the showing of FIGS. 1–7, by utilizing the same procedures described above.

It will therefore be seen that the invention permits persons who have little or no experience in connection with the making of signs or the like by painting, adhesive backed lettering, stencilling, or any other conventional system, can readily form a desird word or phrase on grid 54 with perfect spacing and balance. Further, this is done entirely manually using the components of the kit 10.

The principles of the invention with regard to the relation of the grid 54 to the Helvetica font style may be applied to other font styles, such as the Gothic style. However, the Helvetica font style is very popular for sign forming purposes and the like and the grid 54 is specifically adapted in its proportioning for the Helvetica font style.

The tack and adhesion differential between the pressure sensitive adhesives of the lettering and numerals and the transfer sheet permits ready application of the letters and numerals to the grid, to form the desired word or phrase unit in perfect spacing and balance, while providing for pick up and transfer to the desired substrate surface for permanent use without in any way disturbing the orientation of the letters and/or the numerals employed in a particular word unit as they are oriented when the word or phrase unit is formulated on the grid.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

We claim:

1. In a lettering kit arrangement providing English alphabet letters of a predetermined font and nominal height for manually applying selected letters thereof to a selected substrate in a predetermined order and spacing, having their undersides coated with a pressure sensitive adhesive and releasably mounted on the release agent coated side of a backing sheet, an alignment grid sheet bearing an alignment grid for laying out said selected letters aligned in their said predetermined order on one side of same that is release agent coated, and a transfer sheet having one side of same coated with a pressure sensitive adhesive to which is releasably adhered a release coated backing that is removed for laying said one side of same over the laid out letters for pressure sensitive adherance thereto and manual transfer and application to the substrate, the improvement wherein:

said grid comprises a working face, including a head horizontal base line indicia and a foot horizontal base line indicia delineated on said one side of said grid sheet, said foot base line indicia comprising a top base line, a middle base line and a bottom base line extending in parallelism across said one side of said grid sheet with said middle base line centered between said top and bottom base lines, said head base line indicia comprising a base line spaced above said middle base line of said foot base line indicia a dimension approximating three-fourths of said foot lettering nominal height, said font base line indicia top and bottom base lines being spaced from the middle base line thereof a distance approximating one-half the difference between the height of the font capital letters that have horizontally rectilinear upper and lower ends and the height of the font capital letters that have rounded upper and lower ends, said grid working face further comprising closely spaced vertical lines delineated on said one side of said grid sheet across said face, said transfer sheet comprising a transparent film bearing said pressure sensitive adhesive, said grid having a length to receive for layout purposes a predetermined number of the font letters for word forming purposes and said transfer sheet having a length that approximates the length of said grid, with the adhesive coating of said letters having a release from said one side of said grid that is on the order of twenty grams and a release from the substrate that exceeds two hundred grams, with the adhesive coating of said transfer sheet when said backing sheet thereof is removed having a release from the top sides of said letters that is in the range of from about seventy to ninety grams and a release from the substrate that is in the range of from about one hundred to about one hundred twenty grams, said font letters being layable out in uniform horizontal alignment by laying the lower ends of the font capital letters with horizontally rectilinear lower ends aligned with the top base line of said foot base line indicia, laying out the font lower case rounded letters with their lower ends aligned with the middle base line of said foot base line indicia, laying out the font capital letters that have convexly rounded lower ends in tangency with the lower base line of said foot base line indicia, and laying out the font elongated lower case letters with horizontally rectilinear upper portions thereof aligned with said base line of said head base line indicia, with predetermined vertical line separation between adjacent letters to achieve said spacing.

2. The improvement set forth in claim 1 wherein the font is Helvetica.

3. The improvement set forth in claim 1 wherein:

said font letters are formed from vinyl, and said film comprising said transfer sheet is polyethylene.

4. The improvement set forth in claim 1 wherein:

said letters include Arabic numerals having their heights in the same dimension proportions as said font capital letters.

5. In a lettering kit arrangement providing English alphabet letters of the Helvetic font and in a predetermined nominal height for manually applying selected letters thereof to a selected substrate in a predetermined order and spacing, having their undersides coated with a pressure sensitive adhesive and releasably mounted on the release agent coated side of a backing sheet, an alignment grid sheet bearing an alignment grid for laying out said selected letters aligned in their said predetermined order on one side of same that is release agent coated, and a transfer sheet having one side of same coated with a pressure sensitive adhesive to which is releasably adhered a release coated backing that is removed for laying said one side of same over the laid out letters for pressure sensitive adherance thereto and manual transfer and burnishing application to the substrate, the improvement wherein:

said grid comprises a working face, including a head horizontal base line guide indicia and a foot horizontal base line guide indicia delineated on said one side of said grid sheet, said foot base line indicia comprising a top base line, a middle base line and a bottom base line extending in parallelism across said one side of said grid sheet with said middle base line centered between said top and bottom base lines, said head base line indicia comprising a base line spaced above said middle base line of said foot base line indicia a dimension substantially equalling three-fourths of said font lettering nominal height, said foot base line indicia top and bottom base lines being spaced from the middle base line thereof a distance substantially equaling one-half the difference between the height of the font capital letters that have horizontally rectilinear upper and lower ends and the height of the font capital letters that have convexly rounded upper and lower ends, said grid working face further comprising closely spaced vertical guidelines delineated on said one side of said grid sheet across said face, said transfer sheet comprising a transparent film bearing said pressure sensitive adhesive, said grid having a length to receive for layout purposes a predetermined number of the font letters for word forming purposes and said transfer sheet having a length that is comparable to the length of said grid, with the adhesive coating of said letters having a release from said one side of said grid that is on the order of twenty grams and a release from the substrate that exceeds two hundred grams, with the adhesive coating of said transfer sheet when said backing sheet thereof is removed having a release from the top sides of said letters that is in the range of from about seventy to ninety grams and a release from the substrate that is in the range of from about one hundred to about one hundred twenty grams, said font letters being layable out in uniform horizontal alignment by laying the lower ends of the font capital letters with horizontally rectilinear lower ends aligned with the top base line of said foot base line indicia, laying out the font lower case rounded letters with the lower ends aligned with the middle base line of said foot base line indicia, laying out the font capital letters that have convexly rounded lower ends in tangency with the lower base line of said foot base line indicia, and laying out the font elongated lower case letters with horizontally rectilinear upper portions thereof aligned with said base line of said head base line indicia, with predetermined vertical line separation between adjacent letters.

6. The improvement set forth in claim 5 wherein:

said font letters are formed from vinyl, and said film comprising said transfer sheet is polyethylene.

7. The improvement set forth in claim 5 wherein:

said letters include Arabic numerals having their heights in the same dimension proportions as said font capital letters.

8. The improvement set forth in claim 5 wherein:

said vertical guidelines have a spacing equivalent to sixty-nine subdivisions in five inches of length of said grid across its face.

9. In a lettering kit arrangement providing English alphabet letters of the Helvetic font and in a predetermined nominal height for manually applying selected letters thereof to a selected substrate in a predetermined order and spacing, having their undersides coated with a pressure sensitive adhesive and releasably mounted on the release agent coated side of a backing sheet, an alignment grid sheet bearing an alignment grid for laying out said selected letters aligned in their said predetermined order on one side of same that is release agent coated, and a transfer sheet having one side of same coated with a pressure sensitive adhesive to which is releasably adhered a release coated backing that is removed for laying said one side of same over the laid out letters for pressure sensitive adherance thereto and manual transfer and application to the substrate, the improvement wherein said grid comprises:

a working face, including a head horizontal base line indicia and a foot horizontal base line indicia delineated on said one side of said grid sheet, said foot base line indicia comprising a top base line, a middle base line and a bottom base line extending in parallelism across said one side of said grid sheet with said middle base line centered between said top and bottom base lines, said head base line indicia comprising a base line spaced above said middle base line of said foot base line indicia a dimension approximating three-fourths of said font lettering nominal height, said foot base line indicia top and bottom base lines being spaced from the middle base line thereof a distance approximating one-half the difference between the height of the font capital letters that have horizontally rectilinear upper and lower ends and the height of the font capital letters that have rounded upper and lower ends, said grid working face further comprising closely spaced vertical lines delineated on said one side of said grid sheet across said face, said grid having a length to receive for layout purposes a predetermined number of the font letters for word forming purposes, said font letters being layable out in uniform horizontal alignment by laying the lower ends of the font capital letters with horizontally rectilinear lower ends aligned with the top base line of said foot base line indicia, laying out the font lower case rounded letters with their lower ends aligned with the middle base line of said foot base line indicia, laying out the font capital letters that have convexly rounded lower ends in tangency with the lower base line of said foot base line indicia, and laying out the font elongated lower case letters with horizontally rectilinear upper portions thereof aligned with said base line of said head base line indicia, with predetermined vertical line separation between adjacent letters to achieve said spacing.

10. The improvement set forth in claim 9 wherein:

said grid sheet comprises polyethylene sheeting and said release coating thereof is silicone.

11. The method of laying out selected pressure sensitive adhesive backed Helvetica font letters, of a predetermined nominal height, with their adhesive backed sides down and their facing sides up, for pickup and transfer as an assembled unit, by a transfer sheet that has a pressure sensitive adhesive surface on one side of same, to a selected substrate surface, which method comprises:

taking a release agent coated grid which comprises a working face including a head horizontal base line indicia and a foot base horizontal line indicia of which said foot base line indicia comprises a top base line, a middle base line and a bottom base line extending in parallelism across said one side of said grid sheet with said middle base line centered between said top and bottom base lines, with said head base line indicia comprising a base line spaced above said middle base line of said foot base line indicia a dimension approximating three-fourths of said font lettering nominal height, and said foot base line indicia top and bottom base lines being spaced from the middle base line thereof a distance approximating one-half the difference between the height of the font capital letters that have horizontally rectilinear upper and lower ends and the height of the font capital letters that have round upper and lower ends, and with said grid further comprising closely spaced vertical lines across said face and said grid having a length to receive for layout purposes a predetermined number of the font letters to form one of said units for word forming purposes, and forming the units by laying the lower ends of the font capital letters having horizontally rectilinear lower ends aligned with the top base line of said foot base line indicia adhesive backed side down, laying out the font lower case rounded letters with their lower ends aligned with the middle base line of said foot base line indicia adhesive backed side down, laying out the font capital letters that have convexly rounded lower ends in tangency with the lower base line of said foot base line indicia adhesive backed side down, and laying out the font elongated lower case letters with horizontally rectilinear upper portions thereof aligned with said base line of said head base line indicia adhesive backed side down, with predetermined vertical line separation between adjacent letters.

12. The method set forth in claim 11 including:

adhering the adhesive of the letters forming each unit to the grid with light release factor, burnishing from the other side of the transfer sheet, the transfer sheet adhesive surface against the facing sides letters of the unit to be transferred to adhere said facing sides of such letters to the transfer sheet adhesive surface with a release factor that is at least several times that of said light release factor, lifting the transfer sheet from the grid by pulling one end of same from the grid to separate the unit letters one by one from the grid while retaining them adhered as a unit to the transfer sheet adhesive surface, transferring the transfer sheet to the substrate surface, adhering the adhesive of the unit letters to the substrate surface with a release factor that resists pulling of the individual letters away from the substrate surface by burnishing the letters of the unit against the substrate surface from said other side of the transfer sheet, and pulling the transfer sheet from one end of same over on itself longitudinally of the unit, and at an angle of approximately one hundred eighty degrees with respect to the substrate surface, to separate the transfer sheet consecutively from the letters of such unit.

13. For a lettering kit providing English alphabet letters of the Helvetic font and in a predetermined nominal height having their undersides coated with a pressure sensitive adhesive and releasably mounted on the release agent coated side of a backing sheet, and an alignment grid sheet therefor bearing an alignment grid for manually laying out on one side of the grid sheet selected of said letters aligned in a predetermined order and spacing, with said one side of said grid sheet being release agent coated, the improvement wherein said grid comprises:

a working face, including a head horizontal base line indicia and a foot horizontal base line indicia, delineated on said one side of said grid sheet, said foot base line indicia comprising a top base line, a middle base line and a bottom base line extending in parallelism across said one side of said grid sheet with said middle base line centered between said top and bottom base lines, said head base line indicia comprising a base line spaced above said middle base line of said foot base line indicia a dimension approximating three-fourths of said font lettering nominal height, said foot base line indicia top and bottom base lines being spaced from the middle base line thereof a distance approximating one-half the difference between the height of the font capital letters that have horizontally rectilinear upper and lower ends and the height of the font capital letters that have rounded upper and lower ends, said grid working face further comprising closely spaced vertical lines delineated in equal spacing on said one side of said grid sheet across said face, said grid having a length to receive for layout purposes a predetermined number of the font letters for word forming purposes, said font letters being layable out in uniform horizontal alignment by laying the lower ends of the font capital letters with horizontally rectilinear lower ends aligned with the top base line of said foot base line indicia, laying out the font lower case rounded letters with their lower ends aligned with the middle base line of said foot base line indicia, laying out the font capital letters that have convexly rounded lower ends in tangency with the lower base line of said foot base line indicia, and laying out the font elongated lower case letters with horizontally rectilinear upper portions thereof aligned with said base line of said head base line indicia, with predetermined vertical line separation between adjacent letters to achieve said spacing.

14. The improvement set forth in claim 13 wherein:

said letters include Arabic numerals having their heights in the same dimension proportions as said font capital letters.

15. For a lettering kit providing English alphabet letters of the Helvetic font and in a predetermined nominal height having their undersides coated with a pressure sensitive adhesive and releasably mounted on the release agent coated side of a backing sheet, and an alignment grid sheet therefor bearing an alignment grid for manually laying out on one side of the grid sheet selected of said letters aligned in a predetermined order and spacing, with said one side of said grid sheet being release agent coated, the improvement wherein said grid comprises:

a working face, including a foot horizontal base line indicia, delineated on said one side of said grid sheet, said foot base line indicia comprising a top base line, a middle base line and a bottom base line extending in parallelism across said one side of said grid sheet with said middle base line centered between said top and bottom base lines, said foot base line indicia top and bottom base lines being spaced from the middle base line thereof a distance approximating one-half the difference between the height of the font capital letters that have horizontally rectilinear upper and lower ends and the height of the font capital letters that have rounded upper and lower ends, said grid working face further comprising closely spaced vertical lines delineated in equal spacing on said one side of said grid sheet across said face, said grid having a length to receive for layout purposes a predetermined number of the font letters for word forming purposes, said font letters being layable out in uniform horizontal alignment by laying the lower ends of the font capital letters with horizontally rectilinear lower ends aligned with the top base line of said foot base line indicia, laying out the font lower case rounded letters with their lower ends aligned with the middle base line of said foot base line indicia, and laying out the font capital letters that have convexly rounded lower ends in tangency with the lower base line of said foot base line indicia, with predetermined vertical line separation between adjacent letters to achieve said spacing.

16. The improvement set forth in claim 15 wherein:

said letters include Arabic numerals having their heights in the same dimension proportions as said font capital letters.

* * * * *